US012070062B2

(12) United States Patent
An

(10) Patent No.: US 12,070,062 B2
(45) Date of Patent: Aug. 27, 2024

(54) AEROSOL GENERATING DEVICE INCLUDING EXTRACTOR FOR REMOVING AEROSOL GENERATING ARTICLE

(71) Applicant: KT&G CORPORATION, Daejeon (KR)

(72) Inventor: Hwi Kyeong An, Seoul (KR)

(73) Assignee: KT&G CORPORATION, Daejeon (KR)

( * ) Notice: Subject to any disclaimer, the term of this patent is extended or adjusted under 35 U.S.C. 154(b) by 451 days.

(21) Appl. No.: 17/439,182

(22) PCT Filed: Apr. 9, 2021

(86) PCT No.: PCT/KR2021/004514
§ 371 (c)(1),
(2) Date: Sep. 14, 2021

(87) PCT Pub. No.: WO2021/256678
PCT Pub. Date: Dec. 23, 2021

(65) Prior Publication Data

US 2022/0264946 A1 Aug. 25, 2022

(30) Foreign Application Priority Data

Jun. 17, 2020 (KR) ..... 10-2020-0073851

(51) Int. Cl.
*A24F 40/42* (2020.01)
*A24F 40/20* (2020.01)
*A24F 40/51* (2020.01)

(52) U.S. Cl.
CPC ..... *A24F 40/42* (2020.01); *A24F 40/20* (2020.01); *A24F 40/51* (2020.01)

(58) Field of Classification Search
CPC ..... A24F 40/42; A24F 40/40; A24F 40/20; A24F 40/51
See application file for complete search history.

(56) References Cited

U.S. PATENT DOCUMENTS 11,246,342 B2 2/2022 Mahler et al.
2015/0013696 A1* 1/2015 Plojoux ..... A61M 15/06 131/328

(Continued)

FOREIGN PATENT DOCUMENTS

EP 3 632 241 A1 4/2020
KR 10-2018-0129637 A 12/2018

(Continued)

OTHER PUBLICATIONS

International Search Report of PCT/KR2021/004514 dated Jul. 19, 2021 [PCT/ISA/210].

(Continued)

*Primary Examiner* — Hae Moon Hyeon
(74) *Attorney, Agent, or Firm* — Sughrue Mion, PLLC

(57) ABSTRACT

An aerosol generating device includes: a cover portion including an opening into which the aerosol generating article is to be inserted; a main body including an accommodation portion for accommodating the aerosol generating article inserted through the opening; a heater configured to heat the aerosol generating article accommodated in the accommodation portion; an extractor integrally formed with the cover portion such that the extract moves together with the cover portion, and configured to extract the aerosol generating article from the accommodation portion; a driver configured to move the cover portion with respect to the main body; and a processor configured to control the driver such the cover portion is moved after power supply to the heater is stopped.

14 Claims, 7 Drawing Sheets

(56) References Cited

U.S. PATENT DOCUMENTS

| | | | | |
|---|---|---|---|---|
| 2018/0049472 | A1* | 2/2018 | Mahler | A61M 15/06 |
| 2019/0166914 | A1 | 6/2019 | Qiu | |
| 2020/0093183 | A1 | 3/2020 | Zheng et al. | |
| 2020/0093185 | A1 | 3/2020 | Lim | |
| 2021/0076741 | A1 | 3/2021 | Chen et al. | |
| 2021/0100288 | A1* | 4/2021 | Borges | A24F 40/46 |
| 2021/0127742 | A1 | 5/2021 | Kim et al. | |
| 2021/0244096 | A1* | 8/2021 | Van Lancker | A24F 40/50 |
| 2021/0298360 | A1* | 9/2021 | Acconcia | A24F 40/57 |
| 2021/0315277 | A1* | 10/2021 | Mironov | A24F 40/465 |
| 2022/0142251 | A1* | 5/2022 | Korus | H05B 6/105 |
| 2022/0202072 | A1* | 6/2022 | Wei Yim | A24F 40/10 |
| 2022/0273038 | A1* | 9/2022 | Xu | A24F 40/95 |
| 2022/0361574 | A1* | 11/2022 | Reevell | A24F 40/42 |
| 2023/0284687 | A1* | 9/2023 | Moloney | A24F 40/50 |
| 2023/0413910 | A1* | 12/2023 | Bureau | A24F 40/42 |

FOREIGN PATENT DOCUMENTS

| | | | |
|---|---|---|---|
| KR | 10-2019-0022589 | A | 3/2019 |
| KR | 10-2019-0029780 | A | 3/2019 |
| KR | 10-2020-0005939 | A | 1/2020 |
| WO | 2019/170901 | A1 | 9/2019 |
| WO | 2019/228037 | A1 | 12/2019 |
| WO | 2019/228429 | A1 | 12/2019 |
| WO | 2020/013544 | A1 | 1/2020 |

OTHER PUBLICATIONS

Written Opinion of PCT/KR2021/004514 dated Jul. 19, 2021 [PCT/ISA/237].

Communication dated Aug. 1, 2022 from the Korean Patent Office in Korean Application No. 10-2020-0073851.

Extended European Search Report date Feb. 21, 2022 in European Application No. 21759228.6.

* cited by examiner

[Fig. 1A]
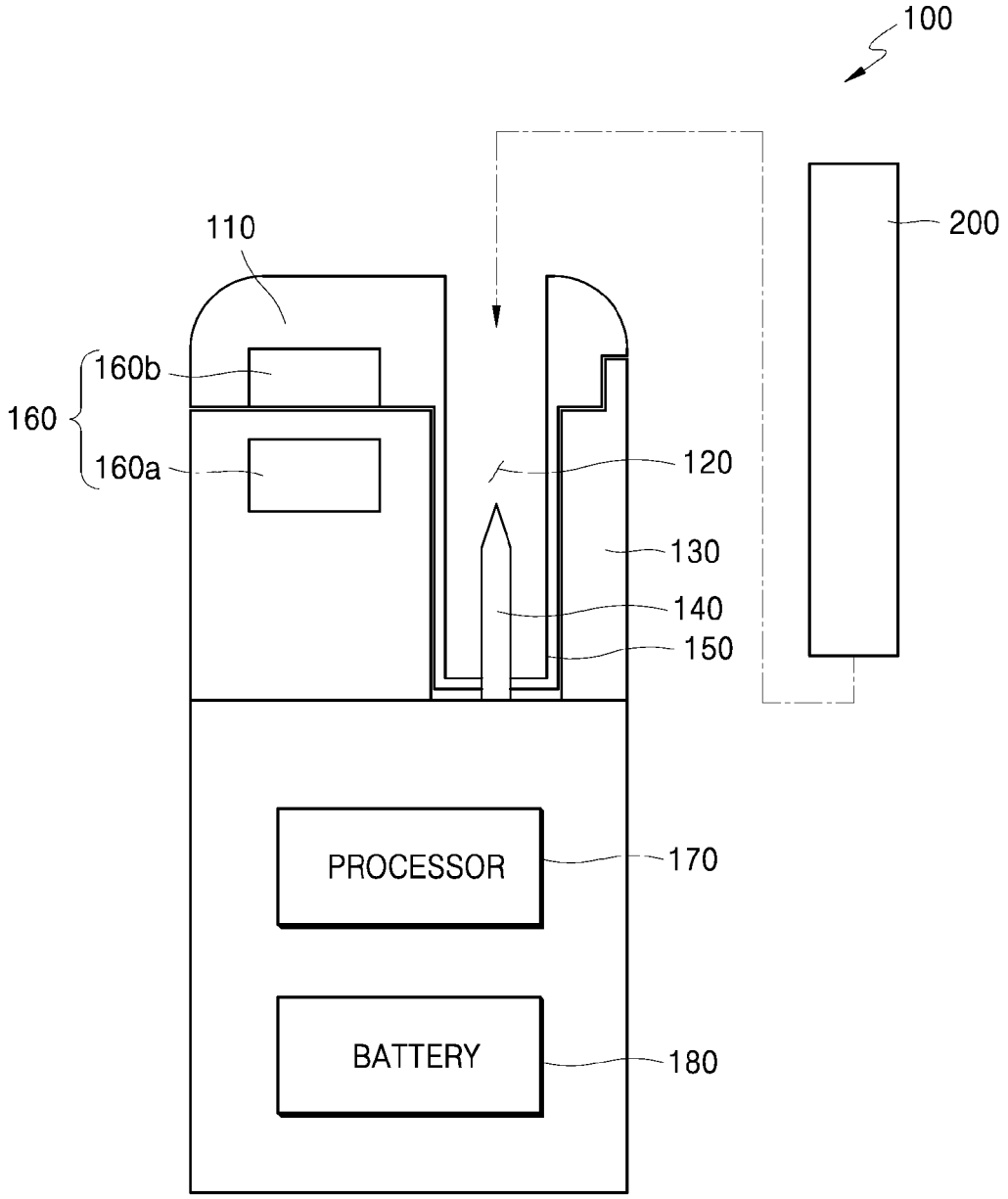

[Fig. 1B]
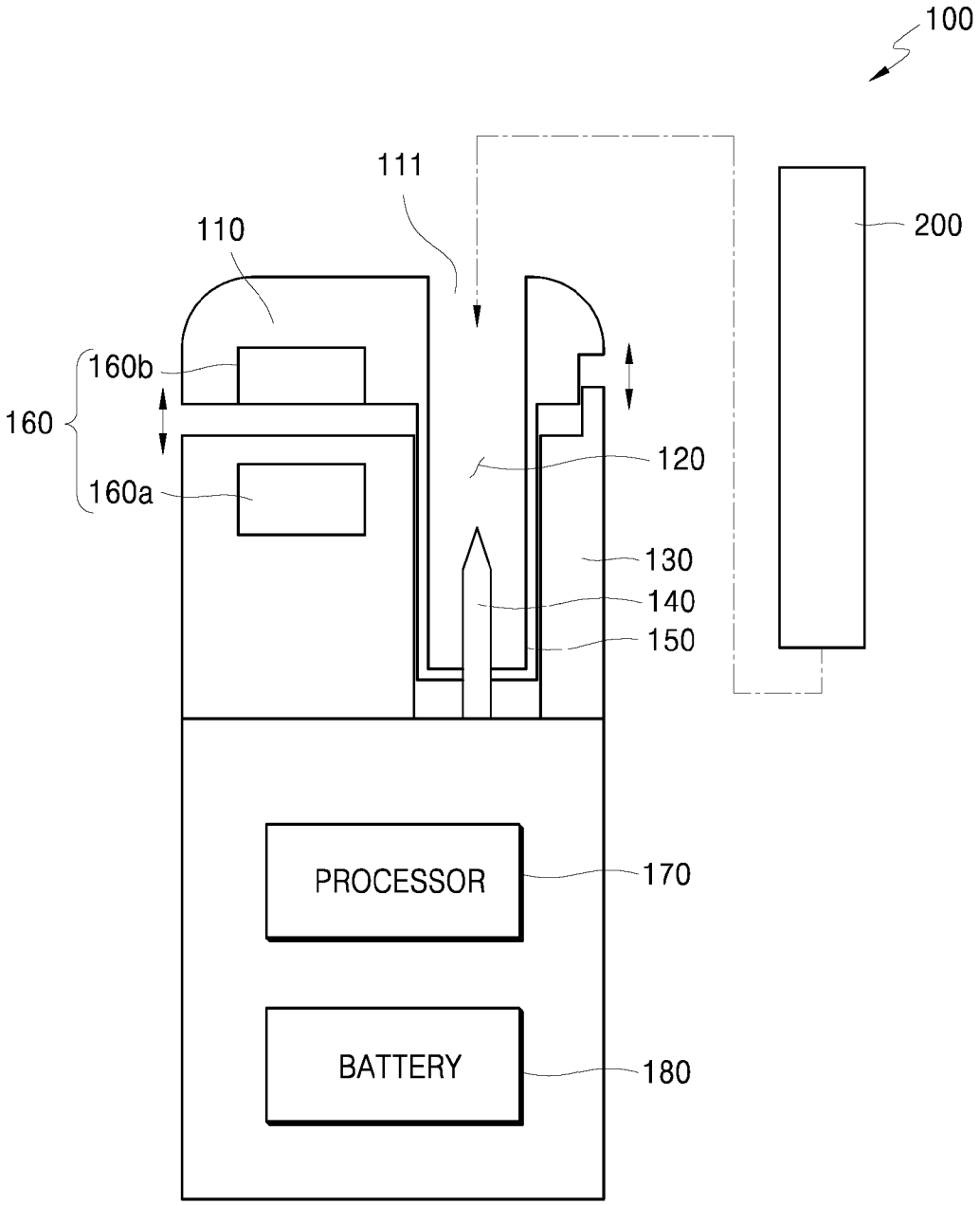

[Fig. 2A]
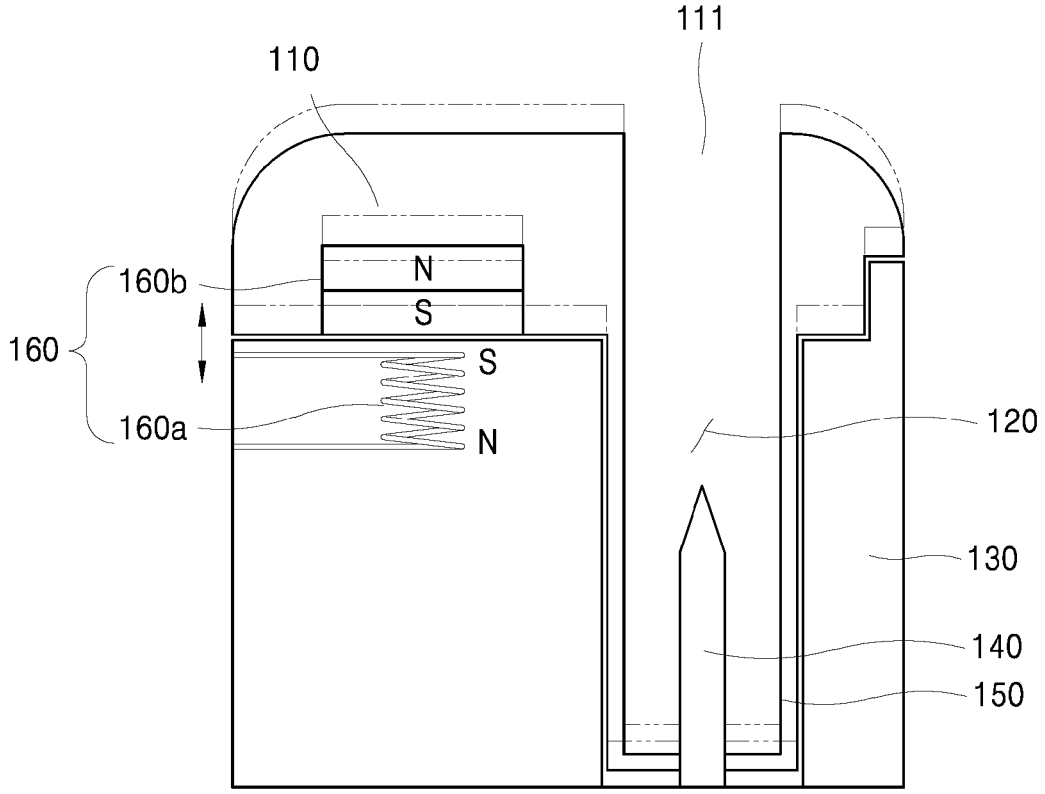
[Fig. 2B]
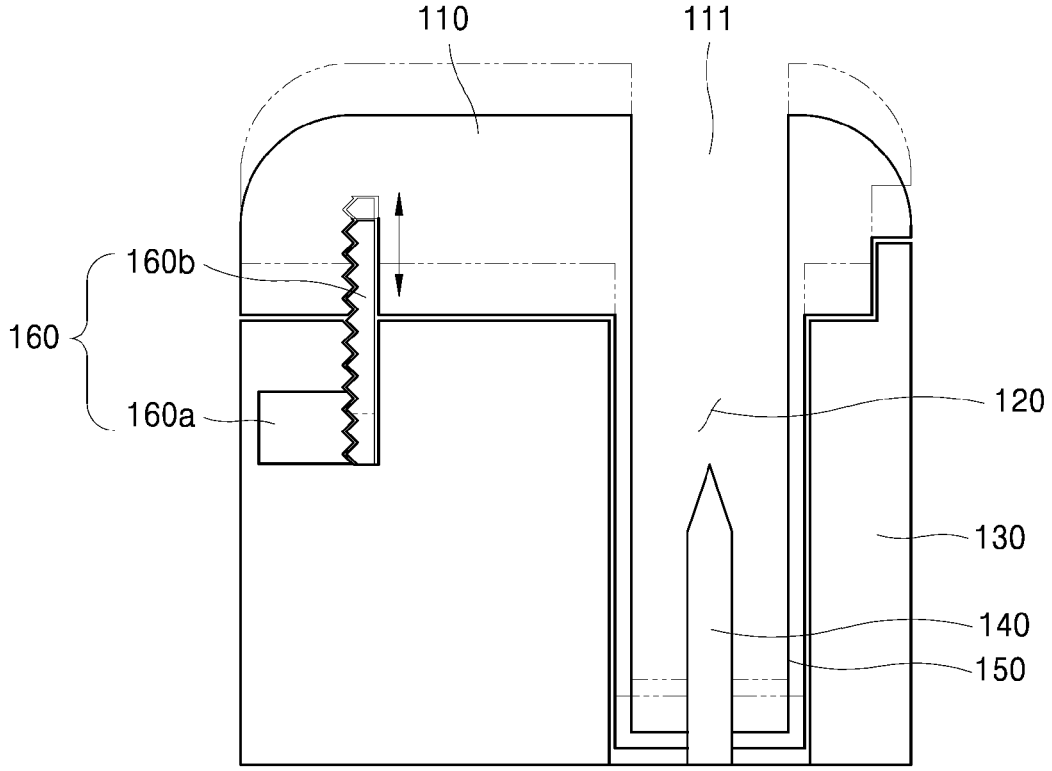

[Fig. 2C]
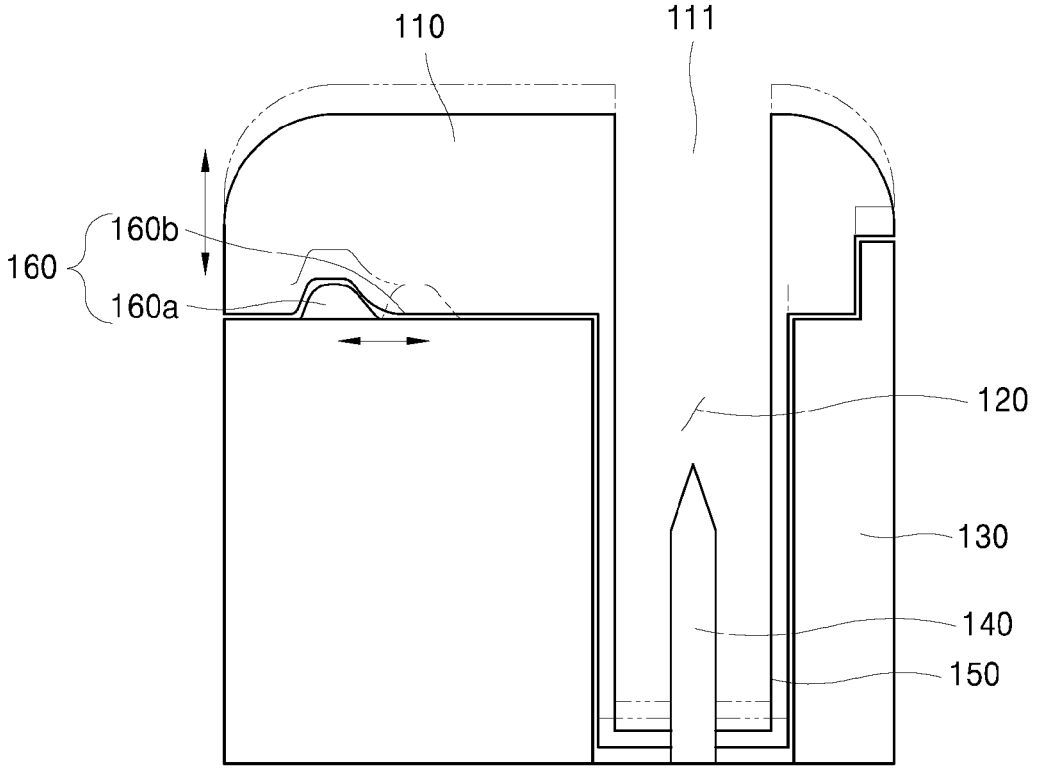
[Fig. 2D]
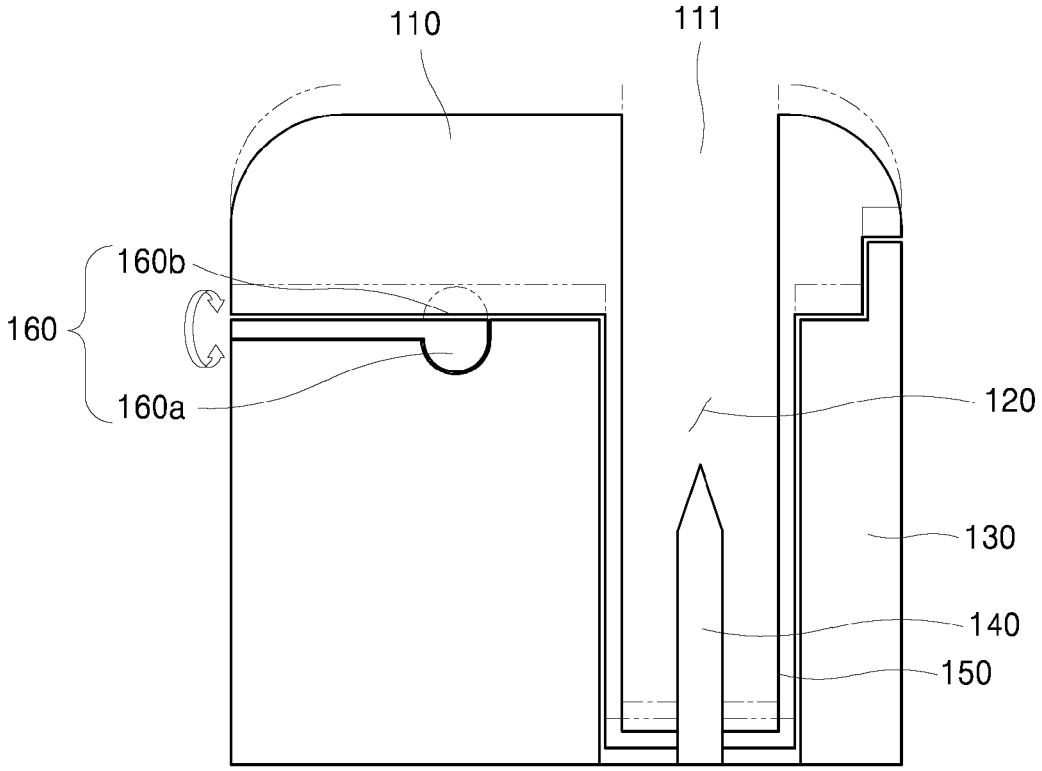

[Fig. 3]
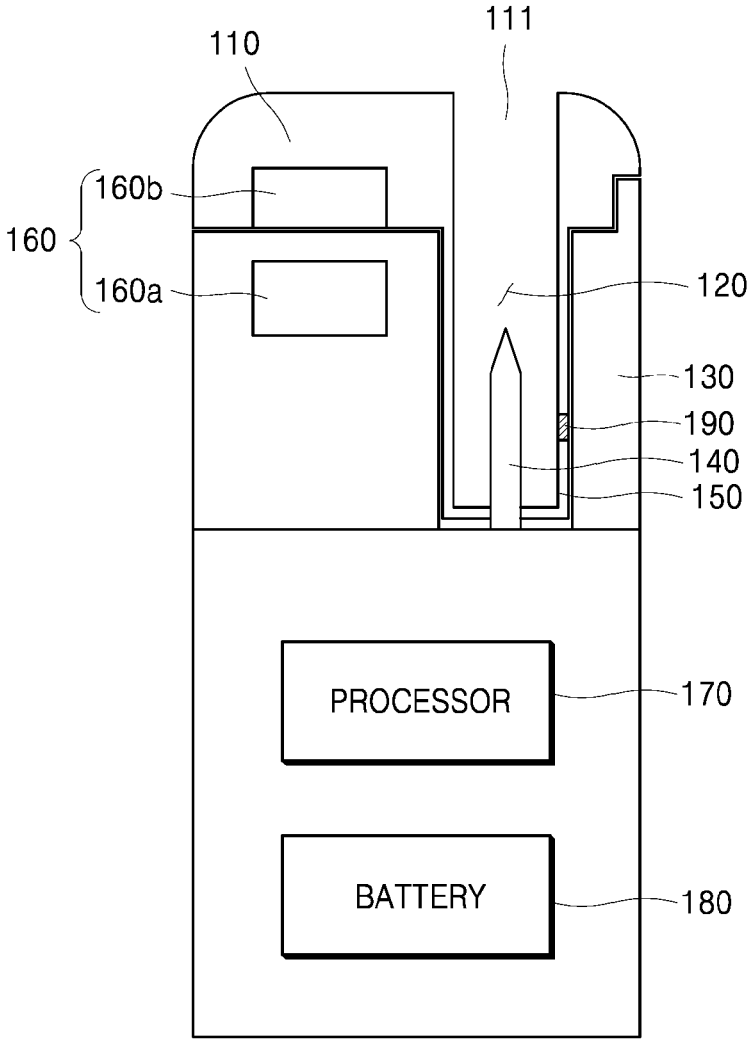

[Fig. 4]
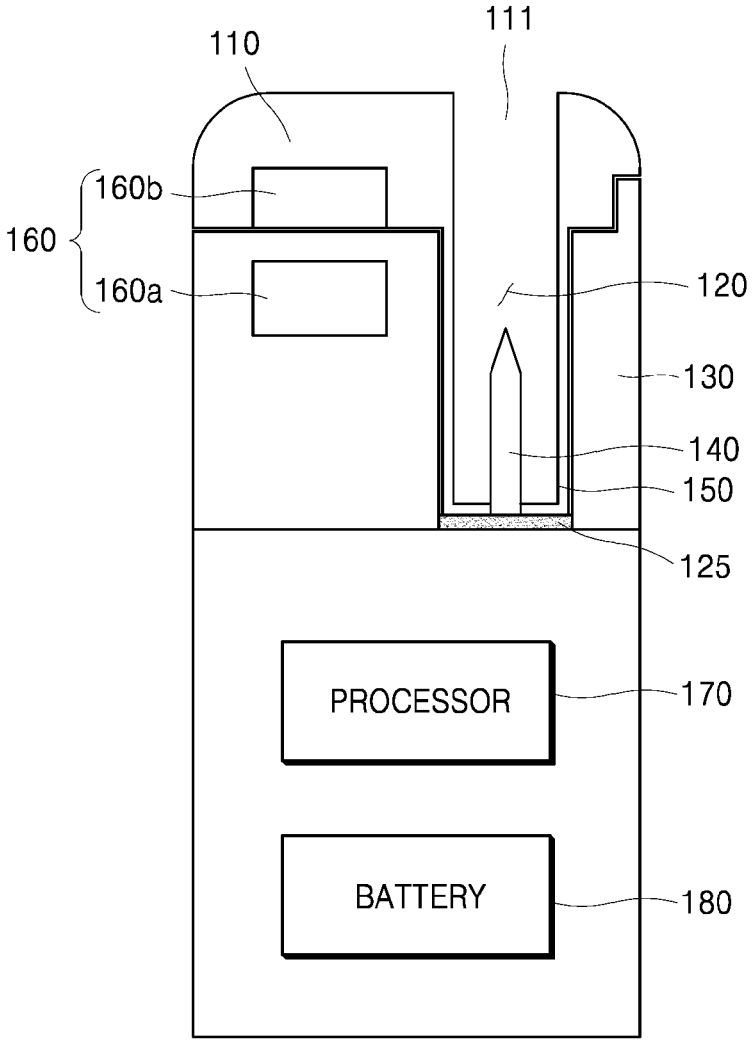

[Fig. 5]
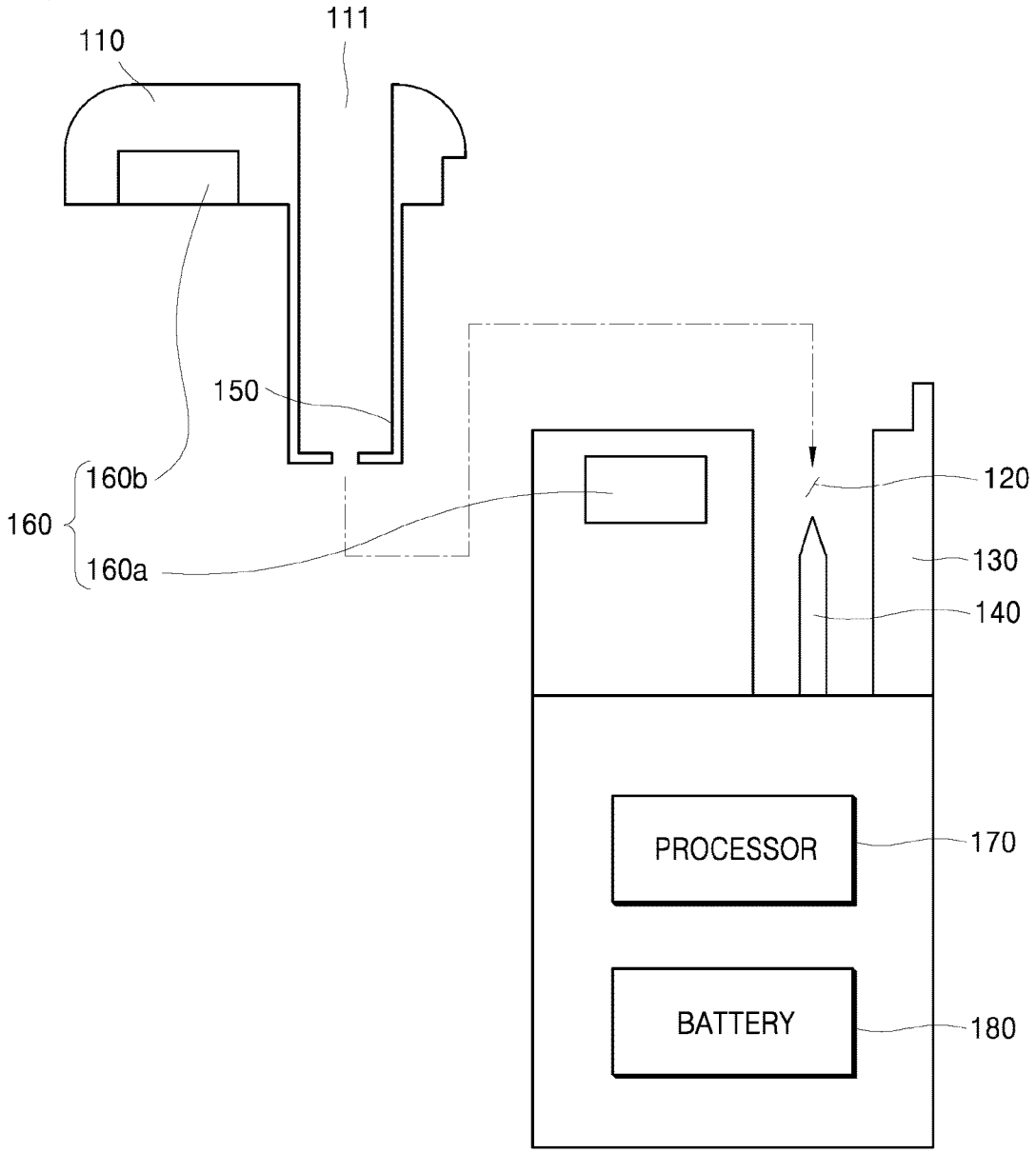

AEROSOL GENERATING DEVICE INCLUDING EXTRACTOR FOR REMOVING AEROSOL GENERATING ARTICLE

CROSS REFERENCE TO RELATED APPLICATIONS

This application is a National Stage of International Application No. PCT/KR2021/004514, filed Apr. 9, 2021, claiming priority to Korean Patent Application No. 10-2020-0073851, filed Jun. 17, 2020.

TECHNICAL FIELD

The embodiments relate to an aerosol generating device, and more particularly, to an aerosol generating device including a cover portion and an extractor integrally formed with the cover portion.

BACKGROUND ART

Recently, the demand for alternative methods to overcome the disadvantages of traditional cigarettes has increased. For example, there is growing demand for an aerosol generating device which generates an aerosol by heating an aerosol generating material in cigarettes, rather than by combusting cigarettes. Accordingly, researches on a heating-type cigarette or a heating-type aerosol generating device have been actively conducted.

DISCLOSURE OF INVENTION

Technical Problem

An aerosol generating article such as a cigarette or a cartridge may be inserted into an aerosol generating device and heated to generate an aerosol. After a user uses the aerosol generating article and the aerosol generating device, the aerosol generating article needs to be easily removed from the aerosol generating device.

An extractor for extracting an aerosol generating article and a driver for moving the extractor may be arranged in an aerosol generating device. In this case, the extractor and the driver need to be efficiently arranged in the aerosol generating device.

The technical problems to be achieved by the present embodiments are not limited to the technical problems described above, and other technical problems may be inferred from the following embodiments.

Solution to Problem

An aerosol generating device according to an embodiment includes a cover portion including an opening into which the aerosol generating article is to be inserted; a main body including an accommodation portion for accommodating the aerosol generating article inserted through the opening; a heater configured to heat the aerosol generating article accommodated in the accommodation portion; an extractor integrally formed with the cover portion such that the extract moves together with the cover portion, and configured to extract the aerosol generating article from the accommodation portion; a driver configured to move the cover portion with respect to the main body; and a processor configured to control the driver such the cover portion is moved after power supply to the heater is stopped.

Advantageous Effects of Invention

An aerosol generating device according to the embodiments may include a cover portion and an extractor integrally formed with the cover portion, so the aerosol generating article may be removed by the extractor moving together with the cover portion.

The driver for moving the cover portion may be arranged at a position corresponding to the cover portion, and thus, components of the aerosol generating device may be efficiently arranged in the aerosol generating device.

In the embodiments, the cover portion and the extractor may be cleaned after being separated from a main body. In addition, the cover portion and the extractor may be replaceable as consumables. As the cover portion and the extractor are easily cleaned and replaced, the cover portion and the extractor may be maintained in a clean and hygienic state.

BRIEF DESCRIPTION OF DRAWINGS

FIG. 1A is a cross-sectional view of an aspect of an aerosol generating device according to an embodiment, and FIG. 1B is a cross-sectional view of another aspect of the aerosol generating device according to the embodiment;

FIGS. 2A to 2D are views showing various examples of a driver for moving a cover portion;

FIG. 3 is a cross-sectional view of an aerosol generating device according to another embodiment;

FIG. 4 is a cross-sectional view of an aerosol generating device according to another embodiment; and FIG. 5 is a cross-sectional view of an aerosol generating device according to another embodiment.

BEST MODE FOR CARRYING OUT THE INVENTION

An aerosol generating device according to an embodiment may include a cover portion including an opening into which the aerosol generating article is to be inserted; a main body including an accommodation portion for accommodating the aerosol generating article to be inserted through the opening; a heater configured to heat the aerosol generating article accommodated in the accommodation portion; and an extractor integrally formed with the cover portion such that the extract moves together with the cover portion, and configured to extract the aerosol generating article from the accommodation portion; a driver configured to move the cover portion with respect to the main body; and a processor configured to control the driver such the cover portion is moved after power supply to the heater is stopped.

In addition, the driver may include a first driver arranged in the main body and a second driver arranged in the cover portion.

In addition, the first driver may be radially spaced apart from a longitudinal central axis of the accommodation portion and arranged in parallel with the accommodation portion, and the second driver may be arranged at a position corresponding to the first driver, in the cover portion.

In addition, the first driver may be an electromagnet, and the second driver may be a magnet that interacts with the electromagnet.

In addition, the first driver may be a motor, and the second driver may be a gear connected to the motor.

In addition, the first driver may be a protrusion protruding toward the cover portion, the second driver may be a bottom of the cover portion in contact with the protrusion, and the protrusion may press the bottom of the cover portion by moving in a direction perpendicular to a longitudinal direction of the accommodation portion.

In addition, the protrusion may press the bottom of the cover portion by moving closer to the accommodation portion.

In addition, the protrusion may press the bottom of the cover portion by rotating about a rotation axis perpendicular to a longitudinal direction of the accommodation portion.

In addition, stoppage of the power supply to the heater may be detected based on at least one of the number of puffs of a user and a time required for a puff.

In addition, stoppage of the power supply to the heater may be detected based on insertion or discharge of the aerosol generating article.

The aerosol generating device according to an embodiment may further include a detection sensor for detecting the insertion or the discharge of the aerosol generating article.

In addition, the detection sensor may include at least one of a pressure sensor, an optical sensor, an infrared sensor, an inductive sensor, a capacitance sensor, a resistance sensor, and a geomagnetic sensor.

The aerosol generating device according to an embodiment may further include a sealing portion arranged at a lower end of the accommodation portion to prevent leakage.

In addition, the cover portion and the extractor may be separable from the main body.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and may be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

The term "aerosol generating article" may refer to any article that is designed for smoking by a person puffing on the aerosol generating article. The aerosol generating article may include an aerosol generating material that generates aerosols when heated even without combustion. For example, one or more aerosol generating articles may be loaded in an aerosol generating device and generate aerosols when heated by the aerosol generating device. The shape, size, material, and structure of the aerosol generating article may differ according to embodiments. Examples of the aerosol generating article may include, but are not limited to, a cigarette-shaped substrate and a cartridge. Hereinafter, the term "cigarette" (i.e., when used alone without a modifier such as "general," "traditional," or "combustive") may refer to an aerosol generating article which has a shape similar to a traditional combustive cigarette.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, "embodiment" is a random division for easily describing the disclosure in the present specification, and each embodiment need not be mutually exclusive. For example, configurations disclosed in one embodiment may be applied and implemented in other embodiments and may be changed and applied and implemented without departing from the idea and scope of the present specification.

Meanwhile, terms used in the present specification are for describing the embodiments and are not intended to limit the embodiments. In the present specification, a singular form also includes a plural form unless specifically stated in the phrase.

Throughout the specification, a "longitudinal direction" of a component may be a direction in which a component extends along one axis of the component, and one axis of the component may indicate a direction in which the component extends longer than the other axis across the one axis.

FIG. 1A is a cross-sectional view of an aspect of an aerosol generating device 100 according to an embodiment, and FIG. 1B is a cross-sectional view of another aspect of the aerosol generating device 100 according to the embodiment.

One aspect of the aerosol generating device 100 and another aspect of the aerosol generating device 100 according to movement of a cover portion 110 will be described in detail with reference to FIGS. 1A and 1B.

The aerosol generating device 100 according to the embodiment may generate an aerosol by heating an aerosol generating article 200.

The aerosol generating article 200 may include a tobacco material and/or an aerosol generating material.

The tobacco material may be made of a tobacco sheet or a strand. In addition, the tobacco material may also be made of cut tobacco obtained by chopping the tobacco sheet. The tobacco material may include nicotine. The tobacco material may be a solid or liquid including a tobacco extract.

For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto.

The aerosol generating device 100 may include a cover portion 110 in which an opening 111 is formed. The aerosol generating device 100 may include a main body 130 having an accommodation portion 120 for accommodating the aerosol generating article 200 which is inserted through the opening 111. The cover portion 110 and the main body 130 may be coupled to each other and form an outer shape of the aerosol generating device 100.

The aerosol generating article 200 may pass through the opening 111 of the cover portion 110 to be inserted into the accommodation portion 120 of the main body 130. The cover portion 110 may be coupled to one side of the main body 130. The cover portion 110 and the main body 130 may be detachably coupled to each other, and when a user uses the aerosol generating device 100, the cover portion 110 and the main body 130 may be gripped as one body.

The accommodation portion 120 may be formed in a lengthwise direction (i.e., longitudinal direction) of the aerosol generating device 100. The aerosol generating article 200 and the accommodation portion 120 may have shapes corresponding to each other. For example, when the aerosol generating article 200 has a cylindrical shape, the accommodation portion 120 may also have a cylindrical shape to accommodate the aerosol generating article 200. However, the shapes of the aerosol generating article 200 and the accommodation portion 120 are not limited thereto and may be changed as necessary.

The aerosol generating device 100 may include a heater 140 that heats the aerosol generating article 200 accommodated in the accommodation portion 120. The heater 140 may be arranged in the accommodation portion 120 of the main body 130.

The heater 140 may include an electro-resistive heater. For example, the heater 140 may include an electrically conductive track, and the heater 140 may be heated when currents flow through the electrically conductive track. However, the heater 140 is not limited to the example described above and may include all heaters which may be heated to a desired temperature. Here, the desired temperature may be pre-set in the aerosol generating device 100 or may be set by a user.

As another example, the heater 140 may include an induction heater. In detail, the heater 140 may include an electrically conductive coil for heating the aerosol generating article 200 in an induction heating method, and the aerosol generating article 200 may include a susceptor which may be heated by the induction heater.

In FIGS. 1A and 1B, the heater 140 has a rod needle shape and is arranged in the accommodation portion 120 of the aerosol generating device 100 and is arranged along a longitudinal axis of the aerosol generating device 100, but the shape and arrangement of the heater 140 are not limited thereto.

For example, the heater 140 may include a tube-type heating element, a plate-type heating element, a needle-type heating element, or a rod-type heating element, and may heat the inside or the outside of the aerosol generating article 200, according to the shape of the heating element.

Also, the aerosol generating device 100 may include a plurality of heaters 140. Here, the plurality of heaters 140 may be inserted into the aerosol generating article 200 or may be arranged outside the aerosol generating article 200. Also, some of the plurality of heaters 140 may be inserted into the aerosol generating article 200, and the others may be arranged outside the aerosol generating article 200. In addition, the shape of the heater 140 is not limited to the shape illustrated in FIGS. 1A and 1B, and may include various shapes.

The aerosol generating device 100 may include a processor 170 and a battery 180.

The battery 180 may supply power to be used for the aerosol generating device 100 to operate. For example, the battery 180 may supply power to heat the heater 140 transferring heat to the aerosol generating article 200. Also, the battery 180 may supply power for operations of a display (not shown), vibrator (not shown), etc. mounted in the aerosol generating device 100.

The processor 170 may generally control operations of the aerosol generating device 100. In detail, the processor 170 may operate the aerosol generating device 100 by controlling the battery 180. The processor 170 may control the operation of other components included in the aerosol generating device 100. Also, the processor 170 may check a state of each of the components of the aerosol generating device 100 to determine whether or not the aerosol generating device 100 is able to operate.

The processor 170 may include at least one processor. The processor 170 can be implemented as an array of a plurality of logic gates or can be implemented as a combination of a general-purpose microprocessor and a memory in which a program executable in the microprocessor is stored. It will be understood by one of ordinary skill in the art that the processor 170 can be implemented in other forms of hardware.

The aerosol generating device 100 may include an extractor 150 for extracting the aerosol generating article 200 from the accommodation portion 120.

The extractor 150 may be formed to easily extract the aerosol generating article 200 from the aerosol generating device 100. For example, the extractor 150 may be detachably mounted on the accommodation portion 120 of the aerosol generating device 100 and may be moved within or separated from the accommodation portion 120. As such, the aerosol generating article 200 may be removed from the aerosol generating device 100.

The extractor 150 may include a cavity for accommodating the aerosol generating article 200. That is, when the aerosol generating article 200 is accommodated in the accommodation portion 120 of the aerosol generating device 100, the aerosol generating article 200 may be located in the cavity of the extractor 150 mounted on the accommodation portion 120.

The cavity of the extractor 150 may have a size and a shape corresponding to those of the aerosol generating article 200. For example, when the aerosol generating article 200 has a cylindrical shape such as a cigarette, the cavity of the extractor 150 may have a shape and a size capable of accommodating the cigarette.

The shape and size of the cavity of the extractor 150 may be determined properly such that the extractor 150 is in tight contact with the aerosol generating article 200. As such, the accommodated aerosol generating article 200 may be removed from the aerosol generating device 100 by using the extractor 150. The shape and size of the extractor 150 are not limited the shape and size shown in the drawings.

A through-hole through which the heater 140 may pass may be formed in a lower surface of the extractor 150. Accordingly, when the extractor 150 is detached from the aerosol generating device 100, the heater 140 may pass through the through-hole of the lower surface of the extractor 150 to be located in the cavity of the extractor 150. The heater 140 may effectively heat the aerosol generating article 200 by coming into contact with the aerosol generating article 200 accommodated in the cavity of the extractor 150.

The extractor 150 may be integrally formed with the cover portion 110 as a single body such that the extractor 150 extends from the cover portion 110. When the cover portion 110 and the main body 130 are coupled to each other, the extractor 150 may be inserted into the accommodation portion 120. Fixed portions for fixing the cover portion 110 to the main body 130 may be formed in the extractor 150 and the accommodation portion 120, respectively.

For example, a protrusion (not shown) may be formed on an outer surface of the extractor 150, and a recessed portion (not shown) may be formed on the accommodation portion 120. In this case, when the cover portion 110 and the main body 130 are coupled to each other, the protrusion formed on the outer surface of the extractor 150 may be inserted into the recessed portion of the accommodation portion 120. As such, the cover portion 110 may be fixed to the main body 130.

As necessary, the coupling of the cover portion 110 and the main body 130 is released, and the cover portion 110 may move with respect to the main body 130.

Since the cover portion 110 and the extractor 150 are integrally formed, the extractor 150 may also move according to the movement of the cover portion 110. For example, the cover portion 110 and the extractor 150 may move with respect to the main body 130 in a longitudinal direction of the accommodation portion 120. As the extractor 150 moves in the longitudinal direction of the accommodation portion 120, the aerosol generating article 200 accommodated in the accommodation portion 120 may be extracted.

The aerosol generating device 100 may include a driver 160 for moving the cover portion 110. In this case, the driver 160 may be controlled by the processor 170 to move the cover portion 110. The processor 170 may control the driver 160 after power supply to the heater 140 is stopped.

The driver 160 may include a first driver 160*a* arranged in the main body 130 and a second driver 160*b* arranged in the cover portion 110. The first driver 160*a* and the second driver 160*b* may interact with each other to move the cover portion 110.

For example, the processor 170 may control power supply to the driver 160 by using a battery 180. The driver 160 may be controlled by the processor 170 to move the cover portion 110 away from the main body 130. In addition, the driver 160 may be controlled by the processor 170 to move the cover portion toward the main body 130.

The driver 160 may be arranged in parallel with the accommodation portion 120. That is, the driver 160 may be arranged to be spaced apart in a radial direction from a longitudinal central axis of the accommodation portion 120. For example, the first driver 160*a* arranged in the main body 130 may be radially spaced apart from the longitudinal central axis of the accommodation portion 120. The second driver 160*b* may be arranged at a position corresponding to that of the first driver 160*a* in the cover portion 110.

FIGS. 1A and 1B illustrate that the first driver 160*a* and the second driver 160*b* are separate components, but the first driver 160*a* and the second driver 160*b* may be coupled to each other to form one member.

FIGS. 2A to 2D are views showing various examples of the driver 160 for moving the extractor 150 integrally formed with the cover portion 110. Mechanisms by which the driver 160 moves the cover portion 110 will be described in more detail with reference to FIGS. 2A to 2D.

Referring to FIG. 2A, the first driver 160*a* of the driver 160 may be an electromagnet, and the second driver 160*b* may be a magnet interacting with the electromagnet. The processor 170 may move the cover portion 110 by controlling power supply from the battery 180 to the electromagnet.

For example, the processor 170 may apply the repulsive force that causes the first driver 160*a* and the second driver 160*b* to push each other by controlling power supply to the electromagnet (i.e., the first driver 160*a*). That is, the processor 170 may control a direction of a current so that one end of the electromagnet close to the magnet has the same pole as the magnet. Accordingly, the repulsive force may be exerted between the electromagnet and the magnet.

By the repulsive force, the cover portion 110 may move away from the main body 130, and the extractor 150 connected to the cover portion 110 may also move away from a bottom of the accommodation portion 120. In this case, the extractor 150 may extract the aerosol generating article 200 accommodated in the accommodation portion 120.

In addition, the processor 170 may apply the attractive force that causes the first driver 160*a* and the second driver 160*b* pull each other by controlling power supply to the electromagnet (i.e., the first driver 160*a*). That is, the processor 170 may control a direction of a current so that one end of the electromagnet close to the magnet has a pole different from a pole of the magnet. Accordingly, the attractive force may be exerted between the first driver 160*a* and the second driver 160*b*.

By the attractive force, the cover portion 110 may move toward the main body 130, and the extractor 150 connected to the cover portion 110 may also move toward the bottom of the accommodation portion 120.

Referring to FIG. 2B, the first driver 160*a* of the driver 160 may be a motor, and the second driver 160*b* may be a gear connected to the motor. In this case, one end of the gear may be connected to the motor and the other end of the gear may be connected to the cover portion 110. The processor 170 may control power supply to the motor by using the battery 180, and accordingly, may move the cover portion 110.

For example, the processor 170 supplies power to the motor which is the first driver 160*a*, thereby controlling the motor which is the first driver 160*a* to move the gear (i.e., the second driver 160*b*) such that the cover portion 110 moves away from the main body 130. That is, one end of the gear connected to the motor may be displaced upward in FIG. 2B. Accordingly, the other end of the gear connected to the cover portion 110 may apply a force to the cover portion 110 so that the cover portion 110 moves away from the main body 130.

The cover portion 110 may be moved away from the main body 130 by the gear, and the extractor 150 connected to the cover portion 110 may move in a direction away from the bottom of the accommodation portion 120. As such, the extractor 150 may extract the aerosol generating article 200 accommodated in the accommodation portion 120.

In addition, the processor 170 may supply power to the motor which is the first driver 160*a*, thereby controlling the motor which is the first driver 160*a* to move the gear (i.e., the second driver 160*b*) such that the cover portion 110 moves toward the main body 130. That is, one end of the gear connected to the motor may be displaced downward in FIG. 2B. Accordingly, the other end of the gear connected to the cover portion 110 may apply a force to the cover portion 110 so that the cover portion 110 moves toward the main body 130.

Accordingly, the extractor 150 connected to the cover portion 110 may also move closer to the bottom of the accommodation portion 120.

Referring to FIGS. 2C and 2D, the first driver 160*a* of the driver 160 may be a protrusion and the second driver 160*b* of the driver 160 may be a bottom of the cover portion 110 which in contact with the protrusion. In this case, the protrusion may move the cover portion 110 by pressing the bottom of the cover portion 110.

For example, as shown in FIG. 2C, the protrusion may move closer to the accommodation portion 120 under control of the processor 170. As the protrusion moves closer to the accommodation portion 120 in a horizontal (i.e., a direction perpendicular to a longitudinal direction of the accommodation portion 120), the bottom of the cover portion 110 may be pressed (i.e., pushed) by the protrusion. As such, the cover portion 110 may move away from the main body 130.

As the cover portion 110 moves away from the main body 130, the extractor 150 connected to the cover portion 110 may also move away from the bottom of the accommodation portion 120. As such, the extractor 150 may extract the aerosol generating article 200 accommodated in the accommodation portion 120.

On the other hand, the protrusion may move away from the accommodation portion 120. The processor 170 may control the protrusion so that the protrusion moves away from the accommodating portion 120. As the protrusion is accommodated in the groove formed on the bottom of the cover portion 110, pressing of the protrusion may be removed and the cover portion 110 may move closer to the main body 130.

As the cover portion 110 moves closer to the main body 130, the extractor 150 connected to the cover portion 110 may also move closer to the bottom of the accommodation portion 120.

As another example, the protrusion may press the bottom of the cover portion 110 by rotating as shown in FIG. 2D. The processor 170 may control the protrusion so that the protrusion rotates about a rotation axis perpendicular to a longitudinal direction of the accommodation portion 120.

The protrusion may rotate to face the bottom of the cover portion 110. When the protrusion rotates to come into contact with the bottom of the cover portion 110, the bottom of the cover portion 110 may be pressed by the protrusion. As the bottom of the cover portion 110 is pressed, the cover portion 110 may also be pressed. In this case, the cover portion 110 may move away from the main body 130.

As the cover portion 110 moves away from the main body 130, the extractor 150 connected to the cover portion 110 may also move away from the bottom of the accommodation portion 120. As such, the extractor 150 may extract the aerosol generating article 200 accommodated in the accommodation portion 120.

In addition, the protrusion may rotate in a direction away from the bottom of the cover portion 110. As the protrusion rotates and placed in the groove formed in the main body 130, pressing of the protrusion may be removed, and the cover portion 110 may move closer to the main body 130.

As the cover portion 110 moves closer to the main body 130, the extractor 150 connected to the cover portion 110 may also move closer to the bottom of the accommodation portion 120.

Although not shown in the drawings, as another example, a driver including a shape memory alloy may be arranged between the cover portion 110 and the main body 130. The shape memory alloy may be pre-set to have a specific shape according to supply of a current, and the specific shape may be changed according to a purpose and need.

When a current is supplied to the driver including the shape memory alloy, the driver may be deformed to cause the cover portion 100 to be spaced apart from the main body 130. For example, the driver may increase in length and/or volume according to supply of a current, and thus, the cover portion 110 may be spaced apart from the main body 130.

As the driver including a shape memory alloy separates the cover portion 110 and the main body 130, the cover portion 110 may move away from the main body 130. The extractor 150 connected to the cover portion 110 may also move away from the bottom of the accommodation portion 120, thereby extracting the aerosol generating article 200 accommodated in the accommodation portion 120. The aerosol generating device 100 according to the above-described embodiments may be applied to other embodiments, and the same reference numerals hereinafter may mean substantially the same components as the above-described components.

FIG. 3 is a cross-sectional view of an aerosol generating device 100 according to another embodiment.

The aerosol generating device 100 may include a sensor 190. The sensor 190 may be electrically connected to the processor 170.

The processor 170 may control the driver 160 after power supply to the heater 140 is stopped. For example, stoppage of power supply to the heater 140 may be detected based on the number of puffs of a user and/or a total smoking time.

Specifically, when at least one of the number of puffs and the total smoking time exceeds a preset threshold, the processor 170 may determine that power supply to the heater 140 is stopped.

When it is determined that the power supply to the heater 140 is stopped, the processor 170 may control the driver 160 to move the cover portion 110 away from the main body 130. As the cover portion 110 moves away from the main body 130, the extractor 150 connected to the cover portion 110 may move in the accommodation portion 120. That is, the extractor 150 may move away from a bottom portion of the accommodation portion 120 and extract the aerosol generating article 200 accommodated in the accommodation portion 120.

As another example, stoppage of power supply to the heater 140 may be detected based on insertion or discharge of an aerosol generating article.

The sensor 190 may be a detection sensor that detects insertion or discharge of the aerosol generating article 200. The detection sensor may include at least one of a pressure sensor, an optical sensor, an infrared sensor, an inductive sensor, a capacitance sensor, a resistance sensor, and a geomagnetic sensor.

For example, the detection sensor may be an inductive sensor. The inductive sensor may detect insertion and discharge of the aerosol generating article 200 based on a change in inductance of the accommodation portion 120 according to the insertion and discharge of the aerosol generating article 200.

For another example, the detection sensor may be a pressure sensor. The pressure sensor may detect a pressure applied to a side wall or a lower wall of the accommodation portion 120 when the aerosol generating article 200 is inserted into or discharged from the accommodation portion 120 and may detect insertion and discharge of the aerosol generating article 200 based on a change in pressure of the accommodation portion 120.

The processor 170 may control the driver 160 based on insertion or discharge of the aerosol generating article 200 detected by the detection sensor.

When discharge of the aerosol generating article 200 is detected by the detection sensor, the processor 170 may control the driver 160 to move the cover portion 110 away from the main body 130. As the cover portion 110 moves away from the main body 130, the extractor 150 connected to the cover portion 110 may move in the same direction. That is, the extractor 150 may move away from a bottom of the accommodation portion 120 and extract the aerosol generating article 200 accommodated in the accommodation portion 120.

When insertion of the aerosol generating article 200 is detected by the detection sensor, the processor 170 may control the driver 160 to move the cover 110 toward the main body 130. As the cover portion 110 moves to be closer to the main body 130, the extractor 150 connected to the cover portion 110 may move in the same direction. That is, the extractor 150 may move toward the bottom portion of the accommodation portion 120.

FIG. 4 is a cross-sectional view of an aerosol generating device 100 according to another embodiment.

As shown in FIG. 4, the aerosol generating device 100 may include a sealing portion 125 arranged at a lower end of the accommodation portion 120 to prevent leakage.

When the aerosol generating article 200 is heated, an atomized aerosol may be liquefied again to form droplets. In this case, the droplets may be collected at the bottom of the accommodation portion 120. The sealing portion 125 may provide packing at the lower end of the accommodation portion 120 to prevent droplets from leaking from the lower end of the accommodation portion 120 to the main body 130. When the cover portion 110 is coupled to the main body 130, the sealing portion 125 may be arranged at a lower end of the extractor 150. The sealing portion 125 may prevent droplets or residues that may be discharged from the extractor 150 from leaking to the main body 130.

The sealing portion 125 may have a shape and a size corresponding to those of the accommodation portion 120. That is, the sealing portion 125 and the accommodation portion 120 may have substantially the same horizontal cross section, and the sealing portion 125 may be arranged at the bottom of the accommodation portion 120 through fitting.

The sealing portion 125 may include an elastic material. The elastic material may be, for example, rubber or silicone. As the sealing portion 125 includes the elastic material, the sealing portion 125 may tightly seal the lower end of the accommodation portion 120.

FIG. 5 is a cross-sectional view of an aerosol generating device 100 according to another embodiment.

As shown in FIG. 5, the cover portion 110 may be separable from the main body 130. Accordingly, the extractor 150 integrally formed with the cover portion 110 may also be separated from the main body 130.

The cover portion 110 and the extractor 150 may be cleaned with air or water by a user after being separated from the main body 130. In addition, the cover portion 110 and the extractor 150 may be replaced as necessary. That is, the cover portion 110 and the extractor 150 may be replaceable as consumables. As the cover portion 110 and the extractor 150 are easily cleaned and replaced, the cover portion 110 and the extractor 150 may be maintained in a clean and hygienic state.

The aerosol generating device 100 according to the embodiments may include the cover portion 110 and the extractor 150 integrally formed with the cover portion 110. As the extractor 150 is integrally formed with the cover portion 110, the extractor 150 may move along with the cover portion 110.

Embodiments may also include the driver 160 for moving the cover portion 110. That is, the driver 160 may move the cover portion 110, and as the cover portion 110 moves, the extractor 150 may extract the aerosol generating article 200. Accordingly, the driver 160 for moving the cover portion 110 may be arranged at a position corresponding to the cover portion 110, and thus, components of the aerosol generating device 100 may be efficiently arranged in the aerosol generating device 100.

Those skilled in the technical field related to the present embodiments will appreciate that the embodiments may be implemented in a modified form without departing from the essential characteristics of the above-described description. The disclosed methods should be considered in a descriptive sense only and not for purposes of limitation. The scope of the present disclosure is represented in the claims rather than the foregoing description, and all differences within the scope equivalent thereto should be construed as being included in the present disclosure.

The invention claimed is:

1. An aerosol generating device that generates an aerosol by heating an aerosol generating article, the aerosol generating device comprising:

a cover portion including an opening into which the aerosol generating article is to be inserted;

a main body including an accommodation portion for accommodating the aerosol generating article to be inserted through the opening;

a heater configured to heat the aerosol generating article accommodated in the accommodation portion;

an extractor integrally formed with the cover portion such that the extractor moves together with the cover portion, and configured to extract the aerosol generating article from the accommodation portion;

a battery configured to supply power to the heater;

a driver configured to move the cover portion with respect to the main body; and a processor configured to control the driver such that the cover portion is moved after supply of the power to the heater is stopped.

2. The aerosol generating device of claim 1, wherein the driver includes a first driver arranged in the main body and a second driver arranged in the cover portion.

3. The aerosol generating device of claim 2, wherein the first driver is radially spaced apart from a longitudinal central axis of the accommodation portion and arranged in parallel with the accommodation portion, and the second driver is arranged at a position corresponding to the first driver, in the cover portion.

4. The aerosol generating device of claim 2, wherein the first driver is an electromagnet, and the second driver is a magnet that interacts with the electromagnet.

5. The aerosol generating device of claim 2, wherein the first driver is a motor, and the second driver is a gear connected to the motor.

6. The aerosol generating device of claim 2, wherein the first driver is a protrusion protruding toward the cover portion, the second driver is a bottom of the cover portion in contact with the protrusion, and the protrusion is configured to press the bottom of the cover portion by moving in a direction perpendicular to a longitudinal direction of the accommodation portion.

7. The aerosol generating device of claim 6, wherein the protrusion is configured to press the bottom of the cover portion by moving closer to the accommodation portion.

8. The aerosol generating device of claim 6, wherein the protrusion is configured to press the bottom of the cover portion by rotating about a rotation axis perpendicular to a longitudinal direction of the accommodation portion.

9. The aerosol generating device of claim 1, wherein the processor is configured to detect stoppage of the supply of the power to the heater based on at least one of a number of puffs and a total smoking time.

10. The aerosol generating device of claim 1, wherein the processor is configured to detect stoppage of the supply of the power to the heater based on insertion or discharge of the aerosol generating article.

11. The aerosol generating device of claim 10, further comprising a detection sensor configured to detect the insertion or the discharge of the aerosol generating article.

12. The aerosol generating device of claim 11, wherein the detection sensor includes at least one of a pressure sensor, an optical sensor, an infrared sensor, an inductive sensor, a capacitance sensor, a resistance sensor, and a geomagnetic sensor.

13. The aerosol generating device of claim 1, further comprising a sealing portion arranged at a lower end of the accommodation portion and configured to prevent leakage.

14. The aerosol generating device of claim 1, wherein the cover portion and the extractor are separable from the main body.

* * * * *